US008022021B2

(12) United States Patent
Burrington et al.

(10) Patent No.: US 8,022,021 B2
(45) **Date of Patent: *Sep. 20, 2011**

(54) LOW ASH CONTROLLED RELEASE GELS

(75) Inventors: James D. Burrington, Gates Mills, OH (US); Lewis A. Williams, Willoughby Hills, OH (US); Jack C. Kelley, Chagrin Falls, OH (US); David A. McCaughey, Hudson, OH (US); Frank M. van Lier, Highland Heights, OH (US); David B. Skursha, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 933 days.

This patent is subject to a terminal disclaimer.

(21) Appl. No.: 11/671,009

(22) Filed: Feb. 5, 2007

(65) Prior Publication Data

US 2008/0188386 A1 Aug. 7, 2008

(51) Int. Cl.
*C10M 133/56* (2006.01)
*C10M 159/24* (2006.01)
*C10M 145/18* (2006.01)

(52) U.S. Cl. ..... 508/192; 508/382; 508/391; 508/466; 508/467

(58) Field of Classification Search ..... 508/192, 508/382, 391, 466, 467
See application file for complete search history.

(56) References Cited

U.S. PATENT DOCUMENTS

| | | | | |
|---|---|---|---|---|
| 2,310,305 | A | 2/1943 | Miller et al. | |
| 3,336,223 | A | 8/1967 | Kneeland | 252/9 |
| 3,749,247 | A | 7/1973 | Rohde | 210/205 |
| 4,014,794 | A | 3/1977 | Lewis | 210/199 |
| 4,061,572 | A | 12/1977 | Cohen et al. | 210/168 |
| 4,066,559 | A | 1/1978 | Rohde | 252/10 |
| 4,075,098 | A | 2/1978 | Paul et al. | 210/168 |
| 4,144,166 | A | 3/1979 | DeJovine | 210/60 |
| 4,144,169 | A | 3/1979 | Grueschow | 210/168 |
| 4,265,748 | A | 5/1981 | Villani et al. | 210/132 |
| 4,639,255 | A | 1/1987 | Schuettenberg et al. | 44/62 |
| 4,751,901 | A | 6/1988 | Moor | 123/196 A |
| 4,755,289 | A | 7/1988 | Villani | 210/132 |
| 5,032,259 | A | 7/1991 | He et al. | 210/133 |
| 5,042,617 | A | 8/1991 | Brownawell et al. | 184/6.24 |

(Continued)

FOREIGN PATENT DOCUMENTS

CA 2087773 7/1993

(Continued)

OTHER PUBLICATIONS

"Studies on Combustion, Vibration, and Noise in High-Speed Diesel Engines Through Newly Developed Measuring Instruments" (Journal of Eng. For Gas Turbines and Power, Jul. 1988, vol. 110, pp. 377-384).

(Continued)

*Primary Examiner* — Jim Goloboy
(74) *Attorney, Agent, or Firm* — Christopher D. Hilker; Teresan W. Gilbert

(57) ABSTRACT

The present invention relates to a controlled release gel with an ashless component and defined ash-producing component. Further, the invention relates to the use of a controlled release gel with a controlled level of ash-producing (i.e., metal) components for delivery of additives into lubricants wherein the gel has reduced ash and SAPS producing components.

13 Claims, 1 Drawing Sheet

U.S. PATENT DOCUMENTS

Figure 1:
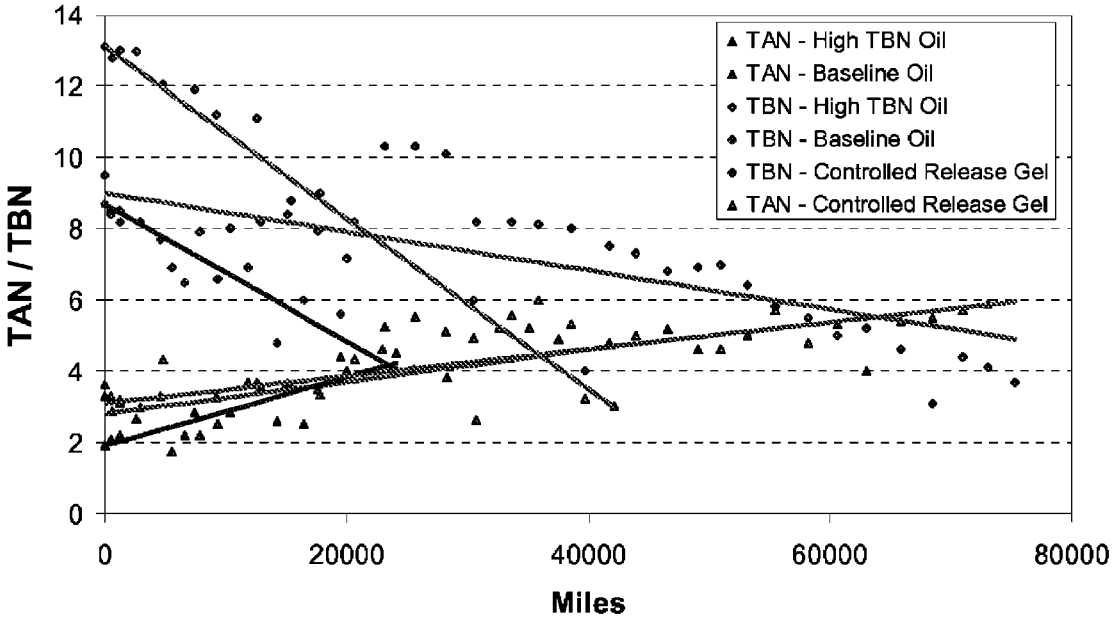

| | | | | |
|---|---|---|---|---|
| 5,059,217 | A | 10/1991 | Arroyo et al. | 44/639 |
| 5,069,799 | A | 12/1991 | Brownawell et al. | 210/749 |
| 5,209,842 | A | 5/1993 | Moor | 210/168 |
| 5,249,552 | A | 10/1993 | Brooks | 123/1 |
| 5,327,861 | A | 7/1994 | Rogalla et al. | 123/196 S |
| 5,374,354 | A | 12/1994 | Baehler et al. | 210/168 |
| 5,435,912 | A | 7/1995 | Baehler et al. | 210/168 |
| 5,456,217 | A | 10/1995 | Thunker et al. | 123/1 A |
| 5,478,463 | A | 12/1995 | Brownawell et al. | 208/180 |
| 5,484,542 | A | 1/1996 | Cahoon et al. | 252/18 |
| 5,507,942 | A | 4/1996 | Davis | 210/94 |
| 5,527,452 | A | 6/1996 | Grigoriev et al. | 210/130 |
| 5,552,040 | A | 9/1996 | Baehler et al. | 210/168 |
| 5,573,557 | A | 11/1996 | Thünker et al. | 44/639 |
| 5,580,359 | A | 12/1996 | Wright | 44/321 |
| 5,591,330 | A | 1/1997 | Lefebvre | 210/203 |
| 5,662,799 | A | 9/1997 | Hudgens et al. | 210/192 |
| 5,695,531 | A | 12/1997 | Makino et al. | 44/639 |
| 5,718,258 | A | 2/1998 | Lefebvre et al. | 137/268 |
| 5,725,031 | A | 3/1998 | Bilski et al. | 141/2 |
| 5,843,284 | A | 12/1998 | Waters et al. | 196/46.1 |
| 5,897,770 | A | 4/1999 | Hatch et al. | 210/101 |
| 6,045,692 | A | 4/2000 | Bilski et al. | 210/198.1 |
| 6,238,554 | B1 | 5/2001 | Martin, Jr. et al. | 210/109 |
| 6,374,797 | B1 | 4/2002 | Fischer | 123/196 R |
| 6,379,564 | B1 | 4/2002 | Rohrbach et al. | 210/765 |
| 6,495,495 | B1 | 12/2002 | Alger et al. | 508/475 |
| 6,505,597 | B2 | 1/2003 | Zulauf et al. | 123/196 R |
| 6,843,916 | B2 | 1/2005 | Burrington et al. | 210/416.5 |
| 7,000,655 | B2 | 2/2006 | Garvin et al. | 141/100 |
| 7,534,747 | B2 * | 5/2009 | Burrington et al. | 508/113 |
| 2002/0014447 | A1 | 2/2002 | Rohrbach et al. | 210/209 |
| 2002/0195384 | A1 | 12/2002 | Rohrbach et al. | 210/266 |
| 2003/0111398 | A1 | 6/2003 | Eilers et al. | 210/209 |
| 2004/0266631 | A1 * | 12/2004 | Burrington et al. | 508/113 |
| 2005/0137097 | A1 | 6/2005 | George et al. | 508/291 |
| 2006/0229215 | A1 | 10/2006 | Burrington et al. | 508/346 |
| 2006/0260874 | A1 | 11/2006 | Lockledge et al. | 184/6.21 |
| 2006/0272597 | A1 | 12/2006 | Burrington et al. | 123/1 A |

FOREIGN PATENT DOCUMENTS

| | | | |
|---|---|---|---|
| DE | 10242850 | | 7/2003 |
| EP | 0258426 | B1 | 7/1990 |
| EP | 0254776 | B1 | 3/1991 |
| EP | 0416908 | | 3/1991 |
| EP | 0915730 | B1 | 5/1999 |
| GB | 589079 | | 6/1947 |
| WO | WO 94/24237 | | 10/1994 |
| WO | WO 02/058815 | | 8/2002 |
| WO | WO 02/096534 | | 12/2002 |
| WO | 2004/007653 | A2 | 1/2004 |
| WO | WO 2006/066767 | | 6/2006 |
| WO | WO 2006/066768 | | 6/2006 |
| WO | 2006/081500 | A1 | 8/2006 |
| WO | 2007/024590 | A1 | 3/2007 |
| WO | 2008/008864 | A2 | 1/2008 |
| WO | 2008/058100 | A2 | 5/2008 |

OTHER PUBLICATIONS

"Deliverables Prepared for Lubrizol", R. Kolar and S. Cullen, Cupertino, CA (Aurigin Consulting, Aug. 23, 2001).

"A Review of Zinc Dialkyldithiophosphates (ZDDPS): Characterisation and Role in the Lubricating Oil", A.M. Barnes, K.D. Bartle, V.R.A. Thibon, Elsevier Science Ltd. (Tribology International 34 [2001], pp. 389-395).

U.S. Appl. No. 11/557,508, filed Nov. 8, 2006, Burrington et al.

"Blending of Alcohols with Diesel Fuels", US/GLO/83/039, E.J. Lom and R.R. Reeves, (U.S. Dept. of Commerce, Natl. Tech. Information Service, Springfield, VA, Jan. 3, 1986, pp. 1-243).

Pub. No. 62218610 A, Japanese Patent Office & Japio Abstract, (Sep. 26, 1987, Hajime, et al.).

Pub. No. 57201510 A, Japanese Patent Office Abstract (Dec. 10, 1982, Shigenori et al.).

Pub. No. 11028318 A, Japanese Patent Office Abstract (Feb. 2, 1999, Hiromichi).

Corresponding Search Report of international Application No. PCT/US2008/052750 dated Aug. 28, 2008.

* cited by examiner

LOW ASH CONTROLLED RELEASE GELS

FIELD OF THE INVENTION

The present invention relates to a low ash controlled release gel with an ash-producing (i.e. metal) component. Further, the invention relates to a controlled release gel that combines ash producing components with ash free components to produce a gel that has reduced ash producing components and reduced SAPS (low sulfur, low phosphorous and low ash) components. Furthermore, the invention relates to the use of a controlled release gel with a controlled level of ash-producing components for delivery of additives into lubricants.

BACKGROUND OF THE INVENTION

The presence of metal from ash producing lubricants is found in automotive emissions and needs to be reduced to meet regulations and to improve efficiency of engines. Engine oils contain detergents and anti-wear agents which typically contain zinc, sulfur, phosphorous, calcium and/or magnesium which help prevent wear in the engine to prevent deposit formations and neutralize acids that form in the oil from the combustion process. The presence of sulfonated ash in the engine exhaust is thought to be a source of particulates which plug diesel particulate filters, thus reducing the filter's efficiency, making regeneration difficult and contributing to the reduced life of the filter. Regulations for maximum level of SAPS (e.g., sulfonated ash, phosphorous and sulfur) levels in the engine oil has created challenges to discover substantially ash free components. Therefore, the use of lubricants with substantially ash free components are needed to meet regulations and reduce emission; however, such components typically, as noted above, are useful in protecting the engine also. Lubricant compositions, in particular, crankcase motor oils are needed that produce low ash to ashless lubricants.

The use of controlled release gels as a means to release lubricant additive over time has been shown to effectively provide additive chemistry to the lubricant thus improving the lubricant's performance efficiency. The controlled release gels based on overbased metal chemistry is described in U.S. Pat. No. 6,843,916B, U.S. Pat. No. 7,000,655, U.S. Ser. No. 10/196,441, U.S. Ser. No. 10/603,644, U.S. Ser. No. 11/506,298, U.S. Ser. No. 11/092,403, U.S. Ser. No. 11/045,815 and U.S. Ser. No. 11/557,508 each incorporated by reference herein. The gels with metal producing components typically have good physical characteristics and good delivery over time of additives as specified by total base number (TBN) per weight of gel into the lubricant. Ash free gels eliminate the ash metal but generally require more gel because TBN's ashless gel components are lower than typical ash containing overbased detergents.

It is desirable to have a lubricant composition that has reduced levels of SAPS as well as preventing wear and deposit formation in the engine.

It is desirable to have a class of controlled release gels that has a reduced amount of ash producing components but still contains TBNs at a level found in ash containing formulations.

It is desirable to have a low ash producing controlled release gel with a (increased) level of TBN delivery per weight of gel.

The present invention provides for the use of a controlled release gel with a controlled level of ash producing components for delivery of additives into lubricants.

The present invention provides for a controlled release gel that has a reduced amount of ash producing component while maintaining good TBN density and good physical gel characteristics as well as reduced emissions.

SUMMARY OF THE INVENTION

The invention relates to a low ash controlled release gel composition comprising:

1) an ashless dispersant;
2) an ashless acid selected from the group consisting of acid formed from a polymer containing acidic groups in the backbone, a polyacidic compound, maleic styrene copolymers and mixtures thereof;
3) an overbased metal detergent, and
4) optionally other lubricant additives;

resulting in a lubricant additive controlled release gel with a controlled level of ash/metal producing components for delivery of additives into a lubricant.

The present invention provides for a controlled release process for supplying one or more desired additives to a lubricant and contacting the lubricant with a gel wherein the gel composition combines a controlled level of SAPS producing components with ash free components that results in a reduced level of ash produced from using the controlled release gel.

The use of a controlled release gel containing an overbased detergent allows for good physical characteristics of the gel as well as good delivery of TBN per weight of gel and reduced level of ash and SAPS produced.

DETAILED DESCRIPTION OF THE INVENTION

The present invention provides for a controlled release gel that has a reduced amount of ash/metal/SAPS producing components for the delivery of desired additives into lubricants. The present invention provides for a controlled release gel that contains ash free components with specified ash metal containing components that provides a process to reduce ash and SAPS levels while maintaining TBN and good physical gel characteristics.

The low ash controlled release gel composition comprises:

The invention relates to a low ash controlled release gel composition comprising:

1) an ashless dispersant;
2) an ashless acid selected from the group consisting of acid formed from a polymer containing acidic groups in the backbone, a polyacidic compound, maleic styrene copolymer and mixtures thereof;
3) an overbased metal detergent, and
4) optionally other lubricant additives;

resulting in a lubricant additive controlled release gel with a controlled level of ash/SAPS producing components for delivery of additives into a lubricant.

The weight ratio of each component above, ashless dispersant (component 1), ashless acid (component 2) and overbased metal detergent (component 3) are each independently selected from the range of about 0.01% to about 99.99% and in another embodiment in the range of about 0.01% to about 60% of the gel. In another embodiment, the overbased metal detergent (component 3) in the controlled release gel is in the range of about less than or equal to 90%, in another embodiment about less than or equal to 50% and in another embodiment about less than or equal to 10% of the gel.

The total amount of ash that dissolves into the lubricant from the controlled release gel is less than the total theoretical amount of dissolved ash in view of the amount of ash component added from the controlled release gel and the amount of ash component in the lubricant. It is believed that some of the ash component from the overbased metal detergent in the controlled release gel is not released into the lubricant over the service life of the controlled release gel. It is unexpected that the ash forming component in the overbased detergent remains in the controlled release gel or is neutralized by the acids produced by the engine during normal service.

For example, if one wanted the total ash in the lubricant to be ≦1.2%, the amount of ash in the (typical commercial) lubricating oils for engines is generally ≦1% then one would achieve the end results of ≦1.2% by many combinations of ash components in the controlled release gel, including the following (only by way of example):

a) ≦1% lubricant and ≦0.2% gel, b) ≦0.7% lubricant and ≦0.5% gel, or c) ≦0.5% lubricant and ≦0.7% gel.

If the total ash and result is to be ≦1% ash, it can be achieved by many combinations of ash component including the following (only by way of example):

a) ≦0.7% from lubricant and ≦0.3% from gel, b) ≦0.5% from lubricant and ≦0.5% from gel, or c) ≦0.3% from lubricant and ≦0.7% from gel.

Further, the controlled release gel has at least one of a sulfated ash, phosphorous and sulfur levels below the SAPS levels of a lubricant and/or controlled release gel formulated to perform to an equivalent high level.

The composition is in the form of a gel. Controlled release gels are materials that comprise mixtures of two or more substances and which exist in a semi-solid state more like a solid than a liquid. The gel exists in a semi-solid state more like a solid than a liquid, see Parker, Dictionary of Scientific and Technical Terms, Fifth Edition, McGraw Hill, © 1994. See, also, Larson, "The Structure and rheology of Complex Fluids", Chapter 5, Oxford University Press, New York, N.Y., © 1999, each which is incorporated herein by reference. The rheological properties of a gel can be measured by small amplitude oscillatory shear testing. This technique measures the structural character of the gel and produces a term called the storage modulus which represents storage of elastic energy and the loss modulus which represents the viscous dissipation of that energy. The ratio of the loss modulus/storage modulus, which is called the loss tangent, or "tan delta" is ≧1 for materials that are liquid-like and ≦1 for materials that are solid-like. The controlled release gels have tan delta values in one embodiment of about ≦0.75, in another embodiment of about ≦0.5 and in another embodiment of about ≦0.3. The controlled release gels have tan delta values in one embodiment of about ≦1, in one embodiment of about ≦0.75, in one embodiment of about ≦0.5 or in one embodiment of about ≦0.3.

The composition is a gel formed by the interaction of an ashless dispersant and an ashless acid overbased metal detergent. In one embodiment the gel network includes the interaction of the ashless dispersant and the ashless acid as well as the interaction of ashless dispersant with overbased detergent to form a gel. In one embodiment, the controlled release gel which finds particular use are those in which gellation occurs through the combination of an ashless acid and an ashless succinimide dispersant. In one embodiment, the ratio of the ashless dispersant to the ashless acid is from about 1:1 to about 1:100, in another embodiment from about 100:1 to about 1:1 from about 4:1 to about 1:1 and in another embodiment from about 4:1 to about 2:1.

The ashless dispersant includes Mannich dispersants, polymeric dispersants, carboxylic dispersants, amine dispersants, and mixtures thereof. In one embodiment the preferred ashless dispersants are polyisobutenyl succinimide dispersant, a dispersant made from a direct addition (DA) of polyisobutenyl succan (PIBSA) or mixtures thereof.

In one embodiment the dispersant is formed from a polyisobutenyl succinimide anhydride, wherein the Mn of the polyisobutylene is in the range of about 500 to about 3500 and in another embodiment about 750 to about 2200, and the average:MAA:polyisobutylene is ≧1.0 and in another embodiment from about 1.1 to about 2.5 and an ethylene diamine polyamine wherein the N:CO molar ratio in the ashless dispersant is > or ≧1.0 and in another embodiment from 1.05 to about 4.0.

Ashless type dispersants are characterized by a polar group attached to a relatively high molecular weight hydrocarbon chain. Typical ashless dispersants include N-substituted long chain alkenyl succinimides, having a variety of chemical structures including typically

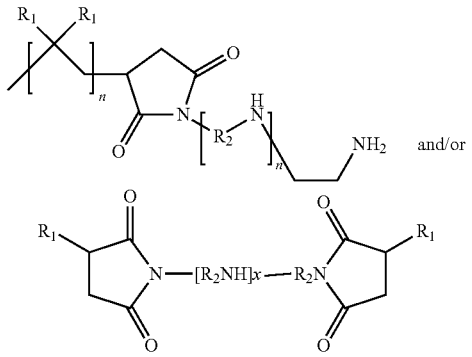

wherein each $R^1$ is independently an alkyl group, frequently a polyisobutyl group, with a molecular weight of 500-5000, and $R^2$ are alkenylene groups, commonly ethylene ($C_2H_4$) groups. Succinimide dispersants are more fully described in U.S. Pat. No. 4,234,435 which is incorporated herein by reference. The dispersants described in this patent are particularly effective for producing a gel in accordance with the present invention.

The ashless dispersant includes, but is not limited to, an ashless dispersant such as a polyisobutenyl succinimide and the like. Polyisobutenyl succinimide ashless dispersants are commercially available products which are typically made by reacting together polyisobutylene having a number average molecular weight ("Mn") of about 300 to 10,000 with maleic anhydride to form polyisobutenyl succinic anhydride ("PIBSA") and then reacting the product so obtained with a polyamine typically containing 1 to 10 ethylene amino groups per molecule. The dispersant so obtained is typically formed from a mixture of different compounds and can be characterized by a variety of different variables including the degree of its amine substitution (i.e., the ratio of the equivalents of amino groups to carbonylic groups, or the N:CO ratio), its maleic anhydride conversion level (i.e., its molar ratio of maleic anhydride to PIB, as defined in U.S. Pat. No. 4,234,435, incorporated herein by reference), the Mn of its PIB group, and its mode of preparation (thermal assisted succination vs. $Cl_2$-assisted succination). Analogous compounds made with other polyamines (e.g. polypropenyl) can also be used. Ashless dispersants of this type are described, for example, in U.S. Pat. No. 4,234,435, which is incorporated herein by reference.

Normally, the N:CO molar ratio of these polyisobutenyl succinimide ashless dispersants will be about 0.6 to 1.6 more typically about 0.7 to 1.4 or even 0.7 to 1.2. In addition or alternatively, the maleic anhydride conversion level of these polyisobutenyl succiminide ashless dispersants will normally be about 1.3, more typically at least 1.5 or even 1.6 or above. In addition or alternatively, the Mn of the polyisobutenyl segments of these polyisobutenyl succinimide ashless dispersants are normally ≧about 350, more typically at least 1200, at least about 1500 or even 1800 or above. In addition or alternatively, these polyisobutenyl succinimide ashless dispersants are also made using $Cl_2$-assisted succination rather than thermal assisted succination, since this produces PISAs of higher conversion than thermally produced PIBSAs (the latter known as DA or direct addition PIBSAs).

The Mannich dispersant are the reaction products of alkyl phenols in which the alkyl group contains at least about 30 carbon atoms with aldehydes (especially formaldehyde) and amines (especially polyalkylene polyamines). Mannich bases having the following general structure (including a variety of different isomers and

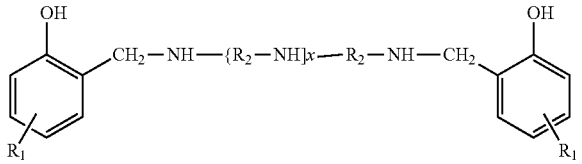

the like) are especially interesting.
and/or

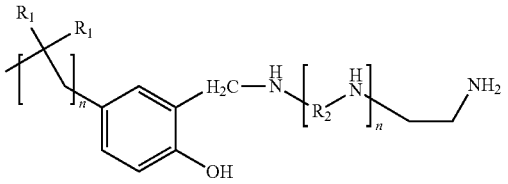

Another class of ashless dispersants is nitrogen containing carboxylic dispersants. Examples of these "carboxylic dispersants" are described in U.S. Pat. No. 3,219,666.

Amine dispersants are reaction products of relatively high molecular weight aliphatic halides and amines, preferably polyalkylene polyamines. Examples thereof are described, in U.S. Pat. No. 3,565,804.

Polymeric dispersants are interpolymers of oil-solubilizing monomers such as decyl methacrylate, vinyl decyl ether and high molecular weight olefins with monomers containing polar substituents, e.g., amino alkyl acrylates or acrylamides and poly-(oxyethylene)-substituted acrylates. Examples of polymer dispersants thereof are disclosed in the following U.S. Pat. Nos. 3,329,658 and 3,702,300.

Ashless dispersants can also be post-treated by reaction with any of a variety of agents. Among these are urea, thiourea, dimercaptothiazoles, carbon disulfide, aldehydes, ketones, carboxylic acids, hydrocarbon-substituted succinic anhydrides, nitrites, expoxides, boron compounds, and phosphorus compounds.

The ashless dispersants can be used alone or in combination. The dispersant is present in the range from about 0.02 wt % to about 99.5 wt % gel, in another embodiment in the range from about 1 wt % to about 70 wt % gel, and in another embodiment in the range from about 5 wt % to about 50 wt % total weight of the gel.

The ashless acid includes a polymer containing acidic groups in the backbone, for example, polymers formed from styrene and maleic anhydride, polymers formed from acrylates including acrylic acid, acrylic acid esters, methacrylic acid and its esters, polymers formed from high molecular weight (Cn wherein n≦12) esters and acids, polymers formed from esterified maleic anhydride styrene copolymers, polymers formed from esterified ethylene diene monomer copolymer; surfactants with acidic groups in the backbone, emulsifiers with acidic groups in the backbone; polyacidic compounds, for example, polyacidic surfactants and/or polyacidic dispersants; functionalized derivatives of each component listed herein and mixtures thereof.

In one embodiment, the ashless acid is formed from the polymerization of styrene and maleic anhydride. The copolymer is partially esterified with one or more $C_6$ to $C_{32}$ alcohol or mixture of alcohols and in another embodiment $C_8$ to $C_{18}$ alcohols. The equivalent ratio of alcohol to acid groups is from about 0.1 wt % to about 0.99 wt % and in another embodiment about 0.45 wt % to about 0.95 wt/%. In one embodiment, the polyacidic surfactants include a maleinated OCP (olefin copolymer of ethylene and propylene). In another embodiment, the polyacidic surfactants include di-isobutenyl succan from the reaction of di-isobutylene and maleic anhydride. In one embodiment, the polyacidic dispersants include succinimide resulting from reaction of equivalent of an ethylene diamine polyamine with maleinated OCP. In another embodiment, the polyacidic dispersants include a succinimide resulting from reaction<1 equivalent of an ethylene diamine polyamine with di-isobutenyl succan. The TAN is ≧1, in another embodiment the TAN is ≧3 (e.g. koH/g and the oil blend viscosity at about 10% oil is 75 cSTO 100 C. and in another embodiment 10 cST o100 C. In one embodiment, the acid must have residual acid groups with a total acid number≧1 and in another embodiment ≧3.

The ashless acids can be used alone or in combination. The ashless acid is present in the range from about 0.02 wt % to about 99.5 wt %, in one embodiment in the range from about 0.1 wt % to about 90 wt %, and in another embodiment in the range from about 1 wt % to about 80 sit % total weight of the gel.

The overbased detergents include overbased metal sulfonates, overbased metal phenates, overbased metal salicylates, overbased metal saliginates, overbased metal carboxylates, overbased calcium sulfonate detergents and the like. The overbased detergents containing metals such as Mg, Ba, Sr, Na, Ca and K and mixtures thereof and the like. The overbeased detergents are described, for example, in U.S. Pat. No. 5,484,542 which is incorporated herein by reference.

The term "overbased" is a term of art which is generic to well known classes of metal salts or complexes. These materials have also been referred to as "basic", "superbased", "hyberbased", "complexes", "metal complexes", "high-metal containing salts", and the like. Overbased detergents are metal salts or complexes characterized by a metal content in excess of that which would be present according to the stoichiometry of the metal and the particular acidic organic compound reacted with the metal, e.g., a sulfonic acid. For example, if a monosulfonic acid,

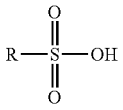

is neutralized with a basic metal compound, e.g., calcium hydroxide, the "neutral" or "normal" metal salt produced will contain one equivalent of calcium for each equivalent of acid, i.e.,

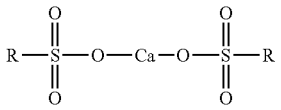

However, as is known in the art, various processes are available which result in an inert organic liquid solution of a product containing more than the stoichiometric amount of metal. The solutions of these products are referred to herein as overbased materials. Following these procedures, the sulfonic acid or an alkali or alkaline earth metal salt thereof can be reacted with a metal base and the product will contain an amount of metal in excess of that necessary to neutralize the acid, for example, 4.5 times as much metal as present in the normal salt or a metal excess of 3.5 equivalents. The actual stoichiometric excess of metal can vary considerably, for example, from about 0.1 equivalent to about 40 or more equivalents depending on the reactions, the process conditions, and the like.

The term "metal ratio" is used herein to designate the ratio of the total chemical equivalents of the metal in the overbased material (e.g., a metal sulfonate or carboxylate) to the chemical equivalents of the metal in the product which would be expected to result in the reaction between the organic material to be overbased (e.g., sulfonic or carboxylic acid) and the metal-containing reactant (e.g., calcium hydroxide, barium oxide, etc.) according to the chemical reactivity and stoichiometry of the two reactants. Thus, in the normal calcium sulfonate discussed above, the metal ratio is one, and in the overbased sulfonate, the metal ratio is 4.5. Obviously, if there is present in the material to be overbased more than one compound capable of reacting with the metal, the "metal ratio" of the material will depend upon whether the number of equivalents of metal in the overbased material is compared to the number of equivalents expected to be present for a given single component or a combination of all such components.

The below cited patents are incorporated herein by reference. U.S. Pat. Nos. 2,616,904; 2,695,910; 2,767,164; 2,767,209; 3,147,232; 3,274,135; etc. disclose a variety of organic acids suitable for preparing overbased materials as well as representative examples of overbased products prepared from such acids. Overbased acids wherein the acid is a phosphorus acid, a thiophosphorus acid, phosphorus acid-sulfur acid combination, and sulfur acid prepared from polyolefins are disclosed in U.S. Pat. Nos. 2,883,340; 2,915,517; 3,001,981; 3,108,960; and 3,232,883. Overbased phenates are disclosed in U.S. Pat. No. 2,959,551 while overbased ketones are found in U.S. Pat. No. 2,798,852.

The overbased detergents may be used alone or in combination. The overbased detergents are present in the range from about 0.1%) to about 99%; in another embodiment from about 1% to about 80% and from about 5% to about 70% and in another embodiment about 18% to about 70% by weight of the total weight of the gel.

Typically, the controlled release gel further contains at least one desired additive for control release into the lubricant. In one embodiment the additive gel may contain one or more desired additives for control release from the gel into the lubricant. The controlled release gel components for release include viscosity modifier(s), friction modifier(s), ashless detergent(s), cloud point depressant(s), pour point depressant(s), demulsifier(s), flow improver(s), anti static agent(s), ashless dispersant(s), ashless antioxidant(s), antifoam(s), corrosion/rust inhibitor(s), extreme pressure/anti-wear agent(s), wear reducing agents, seal swell agent(s), lubricity aid(s), antimisting agent(s), and mixtures thereof, resulting in a controlled release gel that over time releases the desired additive(s) into the lubricant when the controlled release gel is in contact with the lubricant. The desired additive component is further determined by the lubricant formulation, desired performance characteristics, function and the like and further what additive is desired to be added due to depleted additives and/or added as a new additive due to desired functions and/or characteristics.

Ashless antioxidants include alkyl-substituted phenols such as 2,6-di-tertiary butyl-4-methyl phenol, phenate sulfides, phosphosulfurized terpenes, sulfurized esters, aromatic amines, diphenyl amines, alkylated diphenyl amines and hindered phenols, bis-nonylated diphenylamine, nonyl diphenylamine, octyl diphenylamine, bis-octylated diphenylamine, bis-decylated diphenylamine, decyl diphenylamine and mixtures thereof.

The ashless antioxidant includes sterically hindered phenols and includes but is not limited to 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol 2,6-di-tert-butylphenol, 4-pentyl-2-6-di-tert-butylphenol, 4-hexyl-2,6-di-tert-butylphenol, 4-heptyl-2,6-di-tert-butylphenol, 4-(2-ethylhexyl)-2,6-di-tert-butylphenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, 4-tridecyl-2,6-di-tert-butylphenol, 4-tetradecyl-2,6-di-tert-butylphenol, methylene-bridged sterically hindered phenols include but are not limited to 4,4-methylenebis(6-tert-butyl-o-cresol), 4,4-methylenebis(2-tert-amyl-o-cresol), 2,2-methylenebis(4-methyl-6-tert-butylphenol), 4,4-methylene-bis(2,6-di-tertbutylphenol) and mixtures thereof.

Another example of an ashless antioxidant is a hindered, ester-substituted phenol, which can be prepared by heating a 2,6-dialkylphenol with an acrylate ester tinder based conditions, such as aqueous KOH.

Ashless antioxidants may be used alone or in combination. The antioxidants are typically present in the range of about 0 wt % to about 95 wt %, in one embodiment in the range from about 0.01 sit % to 95 wt %, and in another embodiment in the range from about 1 wt % to about 70 wt % and in another embodiment in the range from about 5 wt % to about 60 wt % total weight of the gel.

The extreme pressure/anti-wear agents include a sulfur or chlorosulphur EP agent, a chlorinated hydrocarbon EP agent, or a phosphorus EP agent, or mixtures thereof. Examples of such EP agents are amine salts of phosphorus acid, chlorinated wax, organic sulfides and polysulfides, such as benzyldisulfide, bis-(chlorobenzyl) disulfide, dibutyl tetrasulfide, sulfurized sperm oil, sulfurized methyl ester of oleic acid sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphate, i.e., dibutyl phosphate, diheptyl phosphate, dicyclohexyl phosphate, pentylphenyl phosphate; dipentylphenyl phosphate, tridecyl phosphate, distearyl phosphate and polypropylene substituted phenol phosphate, metal thiocarbamates, such as zinc dioctyldithiocarbamate and barium heptylphenol diacid, such as zinc dicyclohexyl phosphorodithioate and the zinc salts of a phosphorodithioic acid combination may be used and mixtures thereof.

In one embodiment the antiwear agent/extreme pressure agent comprises an amine salt of a phosphorus ester acid. The amine salt of a phosphorus ester acid includes phosphoric acid esters and salts thereof; dialkyldithiophosphoric acid esters and salts thereof; phosphites; and phosphorus-containing carboxylic esters, ethers, and amides; and mixtures thereof.

In one embodiment the phosphorus compound further comprises a sulfur atom in the molecule. In one embodiment the amine salt of the phosphorus compound is ashless, i.e., metal-free (prior to being mixed with other components).

The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain about 2 to about 30 carbon atoms, or in other embodiments about 8 to about 26 or about 10 to about 20 or about 13 to about 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleylamine. Other useful fatty amines include commercially available fatty amines such as "Armeen®" amines (products available from Akzo Chemicals, Chicago, Ill.), such as Armeen C, Armeen O, Armeen O L, Armeen T, Armeen H T, Armeen S and Armeen S D, wherein the letter designation relates to the fatty group, such as cocoa, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. The aliphatic group in this case may be an alkyl group containing about 2 to about 30, or about 6 to about 26, or about 8 to about 24 carbon atoms. Tertiary alkyl amines include monoamines such as tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine.

Mixtures of amines may also be used in the invention. In one embodiment a useful mixture of amines is "Primene® 81R" and "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

Suitable hydrocarbyl amine salts of alkylphosphoric acid may be represented by the following formula:

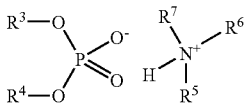

wherein $R^3$ and $R^4$ are independently hydrogen or hydrocarbyl groups such as alkyl groups; for the phosphorus ester acid, at least one of $R^3$ and $R^4$ will be hydrocarbyl. $R^3$ and $R^4$ may contain about 4 to about 30, or about 8 to about 25, or about 10 to about 20, or about 13 to about 19 carbon atoms. $R^5$, $R^6$ and $R^7$ may be independently hydrogen or hydrocarbyl groups, such as alkyl branched or linear alkyl chains with 1 to about 30, or about 4 to about 24, or about 6 to about 20, or about 10 to about 16 carbon atoms. These $R^5$, $R^6$ and $R^7$ groups may be branched or linear groups, and in certain embodiments at least one, or alternatively two of $R^5$, $R^6$ and $R^7$ are hydrogen. Examples of alkyl groups suitable for $R^5$, $R^6$ and $R^7$ include butyl, sec-butyl, isobutyl, tert-butyl, pentyl, n-hexyl, sec-hexyl, n-octyl, 2-ethylhexyl, decyl, undecyl, dodecyl, tridecyl, tetradecyl, pentadecyl, hexadecyl, heptadecyl, octadecyl, octadecenyl, nonodecyl, eicosyl groups and mixtures thereof.

In one embodiment the hydrocarbyl amine salt of an alkylphosphoric acid ester is the reaction product of a C14 to C18 alkylated phosphoric acid with Primene 81R™ (produced and sold by Rohm & Haas) which is a mixture of C11 to C14 tertiary alkyl primary amines.

Similarly, hydrocarbyl amine salts of dialkyldithiophosphoric acid esters of the invention used in the rust inhibitor package may be represented by the formula:

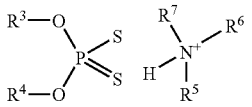

wherein the various R groups are as defined above, although typically both R groups are hydrocarbyl or alkyl. Examples of hydrocarbyl amine salts of dialkyldithiophosphoric acid esters include the reaction product(s) of hexyl, heptyl or octyl or nonyl, 4-methyl-2-pentyl or 2-ethylhexyl, isopropyl dithiophosphoric acids with ethylene diamine, morpholine, or Primene 81R™, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is Propylene oxide. The glycols may be aliphatic glycols having from 1 to about, 12, or from about 2 to about 6, or about 2 to about 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grains) at about 58° C. over a period of about 45 minutes to about 514 grains of hydroxypropyl O,O-di(4-methyl-2-pentyl)phosphorodithioate (prepared by reacting di(4-methyl-2-pentyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulfur, and an acid number of 87 (bromophenol blue).

The EP/antiwear agents are present in the range of about 0 wt % to about 50 wt %, in one embodiment in the range from about 0.25 wt % to about 25 wt % and in another embodiment in the range from about 0.5 wt % to about 10 wt % total weight of the gel.

The antifoams include organic silicones such as poly dimethyl siloxane, poly ethyl siloxane, polydiethyl siloxane, polyacrylates and polymethacrylates, trimethyl-triflouropropylmethyl siloxane and the like.

The antifoams include organic silicones such as poly dimethyl siloxane, poly ethyl siloxane, polydiethyl siloxane, polyacrylates and polymethacrylates, trimethyl-triflouropropylmethyl siloxane and the like.

The antifoams may be used alone or in combination. The antifoams are used in the range of about 0 wt % to about 20 wt %, in one embodiment in the range of about 0.02 wt % to about 10 wt % and in another embodiment in the range of 0.05 wt % to about 2.5 wt % total weight of the gel.

The viscosity modifier provides both viscosity improving properties and dispersant properties. Examples of dispersant-viscosity modifiers include vinyl pyridine, N-vinyl pyrrolidone and N,N'-dimethylaminoethyl methacrylate are examples of nitrogen-containing monomers and the like. Polyacrylates obtained from the polymerization or copolymerization of one or more alkyl acrylates also are useful as viscosity modifiers.

Functionalized polymers can also be used as viscosity modifiers. Among the common classes of such polymers are olefin copolymers and acrylate or methacrylate copolymers. Functionalized olefin copolymers can be, for instance, interpolymers of ethylene and propylene which are grafted with an active monomer such as maleic anhydride and then derivatized with an alcohol or an amine. Other such copolymers are copolymers of ethylene and propylene which are reacted or grafted with nitrogen compounds. Derivatives of polyacrylate esters are well known as dispersant viscosity index modifiers additives. Dispersant acrylate or polymethacrylate viscosity modifiers such as Acryloid™ 985 or Viscoplex™ 6-054, from RohMax, are particularly useful. Solid, oil-soluble polymers such as the PIB (polyisobutylene), methacrylate, polyalkystyrene, ethylene/propylene and ethylene/propylene/1,4-hexadiene polymers and maleic anhydride-styrene interpolymer and derivatives thereof, can also be used as viscosity index improvers. The viscosity modifiers are known and commercially available.

The viscosity modifiers may be used alone or in combination. The viscosity modifiers are present in the range of about 0 wt % to 80 wt %, in one embodiment in the range from about 0.25 at % to about 50 wt % and in another embodiment in the range from about 0.5 wt % to about 10 wt % total weight of the gel.

The friction modifiers include organo-molybdenum compounds, including molybdenum dithiocarbamates, and fatty acid based materials, including those based on oleic acid, including glycerol mono-oleate, those based on stearic acid, and the like.

In one embodiment, the friction modifier is a phosphate ester or salt including a monohydrocarbyl, dihydrocarbyl or a trihydrocarbyl phosphate, wherein each hydrocarbyl group is saturated. In several embodiments, each hydrocarbyl group contains from about 8 to about 30, or from about 12 up to about 28, or from about 14 up to about 24, or from about 14 up to about 18 carbons atoms. In another embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

In one embodiment, the phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435 at Col. 21, line 4 to Col. 27, line 50.

Useful amines include primary ether amines, such as those represented by the formula, $R''(OR')_x—NH_2$, wherein R' is a divalent all-ylene group having about, to about 6 carbon atoms; x is a number from one to about 150, or from about one to about five, or one; and R" is a hydrocarbyl group of about 5 to about, 150 carbon atoms.

The phosphate salt may be derived from a polyamine. The polyamines include alkoxylated diamines, fatty polyamine diamines, alkylenepolyamines, hydroxy containing polyamines, condensed polyamines, arylpolyamines, and heterocyclic polyamines.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, borates, or the like. Suitable metals include alkali metals, alkaline earth metals and transition metals. In one embodiment, the metal is a Group IIA metal, such as calcium or magnesium, Group IIB metal, such as zinc, or a Group VIIB metal, such as manganese. Examples of metal compounds which may be reacted with the phosphorus acid include zinc hydroxide, zinc oxide, copper hydroxide or copper oxide.

In one embodiment, the friction modifier is a phosphite and may be a monohydrocarbyl, dihydrocarbyl or a trihydrocarbyl phosphite, wherein each hydrocarbyl group is saturated. In several embodiments each hydrocarbyl group independently contains from about 8 to about 30, or from about 12 up to about 28, or from about 14 up to about 24, or from about 14 up to about 18 carbons atoms. In one embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

In one embodiment, the friction modifier is a fatty imidazoline comprising fatty substituents containing from 8 to about 30, or from about 12 to about 24 carbon atoms. The substituent may be saturated or unsaturated, preferably saturated. In one aspect, the fatty imidazoline may be prepared by reacting a fatty carboxylic acid with a polyalkylenepolyamine, such as those discussed above. A suitable fatty imidazoline includes those described in U.S. Pat. No. 6,482,777.

The friction modifiers can be used alone or in combination. The friction reducing agents are present in the range of about 0 wt % to 60 wt %, or from about 0.25 wt % to about 40 wt %, or from about 0.5 wt % to about 10 wt % total weight of the gel.

The anti-misting agents include very high (>100,000 Mn) polyolefins such as 1.5 Mn polyisobutylene (for example the material of the trades name Vistanex®), or polymers containing 2-(N-acrylamido), 2-methyl propane sulfonic acid (also known as AMPS®), or derivatives thereof, and the like.

The anti-misting agents can be used alone or in combination. The anti-misting agents are present in the range of about 0 wt % to 10 wt %, or from about 0.25 wt % to about 10 wt %, or from about 0.5 wt % to about 2.5 wt % total weight of the gel.

The corrosion inhibitors include alkylated succinic acids and anhydrides derivatives thereof, organo phosphonates and the like. The rust inhibitors may be used alone or in combination. The rust inhibitors are present in the range of about 0 wt % to about 20 wt %, and in one embodiment in the range from about 0.0005 wt % to about 10 wt % and in another embodiment in the range from about 0.0025 wt % to about 2.5 wt % total weight of the gel.

The ashless metal deactivators include derivatives of benzotriazoles such as tolyltriazole, N,N-bis(heptyl)-ar-methyl-1H-benzotriazole-1-methanamine, N,N-bis(nonyl)-ar-methyl-1H-Benzotriazole-1-methanamine, N,N-bis(decyl)ar-methyl-1H-Benzotriazole-1-methanamine, N,N-(undecyl) ar-methyl-1H-benzotriazole-1-methanamine, N,N-bis (dodecyl)ar-methyl-1H-Benzotriazole-1-methanamine N,N-bis(2-ethylhexyl)-ar-methyl-1H-Benzotriazole-1-methanamine and mixtures thereof. In one embodiment the metal deactivator is N,N-bis(1-ethylhexyl)ar-methyl-1-1H-benzotriazole-1-methanamine; 1,2,4-triazoles, benzimidazoles, 2-alkyldithiobenzimidazoles; 2-alkyldithiobenzothiazoles; 2-N,N-dialkyldithio-carbamoyl)benzothiazoles; 2,5-bis(alkyl-dithio)-1,3,4-thiadiazoles such as 2,5-bis(tert-octyldithio)-1,3,4-thiadiazole 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, 2,5-bis(tert-tridecyldithio)-1,3,4-thiadiazole, 2,5-bis(tert-tetradecyldithio)-1,3,4-thiadiazole, 2,5-bis(tert-octadecyldithio)-1,3,4-thiadiazole, 2,5-bis(tert-nonadecyldithio)-1,3,4-thiadiazole, 2,5-bis(tert-eicosyldithio)-1,3,4-thiadiazole and mixtures thereof; 2,5-bis(N,N-dialkyldithiocarbamoyl)-1,3,4-thiadiazoles; 2-alkydithio-5-mercapto thiadiazoles; and the like.

The ashless metal deactivators may be used alone or in combination. The ashless metal deactivators are present in the range of about 0 wt % to about 50 wt %, or from about 0.0005 wt % to about 25 wt %, or from about 0.0025 wt % to about 10 wt % total weight of the gel.

The demulsifiers include polyethylene and polypropylene oxide copolymers and the like. The demulsifiers may be used alone or in combination. The demulsifiers are present in the range of about 0 wt % to about 20 wt %, or from about 0.0005 wt % to about 10 wt %, or from about 0.0025 wt % to about 2.5 wt % total weight of the gel.

The lubricity aids include glycerol mono oleate, sorbitan mono oleate and the like. The lubricity additives may be used alone or in combination. The lubricity additives are present in the range of about 0 wt % to about 50 wt %, or from about 0.0005 wt % to about 25 it %, or from about 0.0025 wt % to about 10 wt % total weight of the gel.

The flow improvers include ethylene vinyl acetate copolymers and the like. The flow improvers may be used alone or in combination. The flow improvers are present in the range of about 0 wt % to about 50 wt %, or from about 0.0005 wt % to about 25 wt %, or from about 0.0025 wt % to about 5 wt % total weight of the gel.

The cloud point depressants include alkylphenols and derivatives thereof, ethylene vinyl acetate copolymers and the like. The cloud point depressants may be used alone or in combination. The cloud point depressants are present in the range of about 0 wt % to about 50 wt %, or from about 0.0005 wt % to about 25 wt %, or from about 0.0025% to about 5 wt % total weight of the gel.

The pour point depressants include alkylphenols and derivatives thereof, ethylene vinyl acetate copolymers and the like. The pour point depressant may be used alone or in combination. The pour point depressant are present in the range of about 0 wt % to about 50 wt %, or from about 0.0005 wt % to about 25 wt %, or from about 0.0025 wt % to about 5 wt % total weight of the gel.

The seal swell agents include organo sulfur compounds such as thiophene, 3-(decyloxy)tetrahydro-1,1-dioxide, phthalates and the like. The seal swell agents may be used alone or in combination. The seal swell agents are present in the range of about 0 wt % to about 50 wt %, or from about 0.0005 wt % to about 25 wt %, or from about 0.0025 wt % to about 5 wt % total weight of the gel.

The controlled release gel includes a variety of additional ingredients dissolved or dispersed therein. Optionally, other components can be added to the additive gel which includes base stock oils, inert carriers, dyes, bacteriostatic agents, solid particulate additives, and the like so long as these components do not have a detrimental effect on the gel. In addition, such gels will normally contain relatively small amounts of base stock oils, refined or synthetic, as many of these additives are most easily supplied, stored and handled if dissolved in such base stocks, as indicated above. Nonetheless, the controlled release gels of the present invention will typically contain at least about 30 wt. %, more typically at about 50 wt. %, even 70 wt % or event 80 wt. % gel, with the balance being other ingredients as further described herein. Of course, the gels can be composed of 100% gel, if desired.

In one embodiment the properties imparted by the desired additives include dispersancy, antioxidance, corrosion inhibition, wear prevention, scuffing prevention, pitting prevention including micro and macro pitting, friction modifying properties including increased and/or decreased friction coefficients, detergency, viscosity control using viscosity modifiers, foam control or mixtures thereof.

In one embodiment the invention provides a method for lubricating a device. Typically in an engine, the controlled release gel is delivered from within an oil filter, but any means by which the gel can be brought into contact with the lubricant can be used e.g., container/delivery device within the oil pan, or within a fluid by-pass loop.

The controlled release gel is positioned within the lubricated device, anywhere the controlled release gel will be in contact with the lubricant including, lubricant, motor oil, hydraulic fluid, transmission driveline fluid, metal working fluid, industrial fluid, grease and the like. The controlled release gel is positioned anywhere that the circulating lubricant contacts the controlled release gel such as full flow of oil, bypass of the oil in the reservoir or combinations therein. The location of the controlled release gel in the device includes, a filter, drain pan, oil bypass loop, canister, housing, reservoir, pockets of a filter, canister in a filter, mesh in a filter, canister in a bypass system, mesh in a bypass system and the like. One or more locations can contain the controlled release gel. Further, if more than one controlled release gel is used it can be identical, similar and/or a different controlled release gel.

In one embodiment, the controlled release gel is positioned anywhere in the filter of the device. The filter is a desirable location to place the controlled release gel because the controlled release gel and/or spent controlled release gel can easily be removed, and then replaced with a new and/or recycled controlled release gel.

The controlled release gel needs to be in contact with the lubricant of the lubricated device, in one embodiment the controlled release gel is in contact with the lubricant in the range of about 100% to about 1% of the lubricant system, in another embodiment the controlled release gel is in contact with the lubricant in the range of about 75% to about 25% of the lubricant system and in another embodiment the controlled release gel is in contact with the lubricant at about 50% of the lubricant system.

The controlled release gel is added to the device by any known method depending on the desired form of the controlled release gel, the desired speed of addition, the desired release rate, the desired mode of operation and/or any of the combinations of the above. The controlled release gel is added to the system by any known method depending on the total amount of gel that is desired to be released over time, the desired form of the controlled release gel (e.g., stiffness, consistency, homogeneity and the like), the desired overall dissolution of the controlled release gel, the desired release rates of a specific component, the desired mode of operation and/or any combinations of the above. In one embodiment the controlled release composition is a controlled release gel and is added to the lubricating system by means of an injector pump, or a container in the oil filter. In one embodiment the controlled release gel is added to the lubricating system by means of an addition device such as an auger system.

The release rate of the additive components in the controlled release gel is determined primarily by the controlled release gel formulation. The release rate is also dependent on the form of the controlled release gel and/or the mode of addition. The controlled release gel is positioned in a location desirable for the specified and desirable dissolution rate of the specified additives. The controlled release gel's formulation may be composed of one or more components that selectively dissolve completely or a portion of the components remain till the end of its service life or combinations thereof.

The controlled release gel can be used in any lubricating conditioning device including, but not limited to, internal combustion engines, which include mobile and stationary engines, natural gas engines, marine diesel engines, generators, power equipment, hydraulic systems, lubricated mechanical systems, transmission systems, automatic transmission gears, gears, gear boxes, which include manual transmission, differentials, metal working coolant systems, metalworking fluids systems, suspensions systems, industrial lubricated systems and the like.

Use of Product or Process or Device—The controlled release gel may be used in a variety of applications for lubricating systems or a wide variety of machinery. It can be used in any device, system, or process where maintenance of the quality of the lubricant has value. More specifically, those applications which have or will have limits on ash content of the lubricant, including over the road diesel in 2007 (1% ash limit) are applications for this technology. Further, the controlled release gel improves in the prevention of wear and deposit formations in engines and/or lubricating systems.

SPECIFIC EMBODIMENTS

Examples 1-5

The gels of Examples 1-5 were made of the composition shown in the Tables 1-5 below by separately mixing components A and B, heating each component separately to about 100° C. and then combining A and B with mixing and subsequent curing at about 100° C. for about 10 hours to produce the gels listed in Table 1. The cone penetrometer is determined by ASTM D217.

TABLE 1

| Example 1 Component | % wt | A | B |
|---|---|---|---|
| A maleic anhydride/styrene copolymer partially esterified with C16/18 alcohol mixture to SRV 0.69, 40% mineral oil | 10.0% | 10.0% | |
| Nonylated diphenylamine antioxidant | 30.0% | 30.0% | |
| Ashless dispersant made from 2000 Mn $C_{12}$-assisted PIBSA and polyamine. | 5.0% | 5.0% | |
| Ashless dispersant made from 2000 Mn DA PIBSA and triethylene tetraamine | 30.0% | | 30.0% |
| A 400 TBN overbased Ca alkylbenzenensulfonate detergent | 17.2% | | |
| A $10^5$-$10^6$ Mn olefin copolymer in mineral oil, kin vis @ 100 C. (D445_100) = 1500 cSt | 2.8% | | |
| Trialkyl borate corrosion inhibitor | 5.0% | 2.5% | 2.5% |
| Total | 100.0% | 47.5% | 52.5% |
| Cone penetrometer = | 100 mm | | |

TABLE 2

| Example 2 Component | % wt | A | B |
|---|---|---|---|
| A maleic anhydride/styrene copolymer partially esterified with C16/18 alcohol mixture to SRV 0.69, 40% mineral oil | 15.0% | 15.0% | |
| Ashless dispersant made from 2000 Mn $C_{12}$-assisted PIBSA and polyamine. | 10.0% | 10.0% | |
| Ashless dispersant made from 2000 Mn DA PIBSA and triethylene tetraamine | 50.0% | | 50.0% |
| A 400 TBN overbased Ca alkylbenzenensulfonate detergent | 17.2% | | |
| A $10^5$-$10^6$ Mn olefin copolymer in mineral oil, kin vis @ 100 C. (D445_100) = 1500 cSt | 2.7% | | |
| Trialkyl borate corrosion inhibitor | 5.0% | 2.5% | 2.5% |
| Total | 100.0% | 27.5% | 72.5% |
| Cone penetrometer = | 55 mm | | |

TABLE 3

| Example 3 Component | % wt | A | B |
|---|---|---|---|
| A maleic anhydride/styrene copolymer partially esterified with C16/18 alcohol mixture to SRV 0.69, 40% mineral oil | 10.0% | 10.0% | |
| Nonylated diphenylamine antioxidant | 0.0% | 0.0% | |
| Ashless dispersant made from 2000 Mn $C_{12}$-assisted PIBSA and polyamine. | 30.0% | 30.0% | |
| Ashless dispersant made from 2000 Mn DA PIBSA and triethylene tetraamine | 30.0% | | 30.0% |

TABLE 3-continued

| Example 3 | Component | % wt | A | B |
|---|---|---|---|---|
| | A 400 TBN overbased Ca alkylbenzenensulfonate detergent | 21.5% | | |
| | A $10^5$-$10^6$ Mn olefin copolymer in mineral oil, kin vis @ 100 C. (D445_100) = 1500 cSt | 3.5% | | |
| | Trialkyl borate corrosion inhibitor | 5.0% | 2.5% | 2.5% |
| | Total | 100.0% | 42.5% | 57.5% |
| | Cone penetrometer = | 40 mm | | |

TABLE 4

| Example 4 | Component | % wt | A | B |
|---|---|---|---|---|
| | A maleic anhydride/styrene copolymer partially esterified with C16/18 alcohol mixture to SRV 0.69, 40% mineral oil | 7.5% | 7.5% | |
| | Ashless dispersant made from 2000 Mn $C_{12}$-assisted PIBSA and polyamine. | 15.0% | | 15.0% |
| | Ashless dispersant made from 2000 Mn DA PIBSA and triethylene tetraamine | 42.5% | | 42.5% |
| | A 400 TBN overbased Ca alkylbenzenensulfonate detergent | 21.5% | | |
| | A $10^5$-$10^6$ Mn olefin copolymer in mineral oil, kin vis @ 100 C. (D445_100) = 1500 cSt | 3.5% | | |
| | Trialkyl borate corrosion inhibitor | 10.0% | 7.5% | 2.5% |
| | Total | 100.0% | 15.0% | 85.0% |
| | Cone penetrometer = | 85 mm | | |

TABLE 5

| Example 5 | Component | % wt | A | B |
|---|---|---|---|---|
| | A maleic anhydride/styrene copolymer partially esterified with C16/18 alcohol mixture to SRV 0.69, 40% mineral oil | 7.5% | 7.5% | |
| | Nonylated diphenylamine antioxidant | 25.0% | 25.0% | |
| | Ashless dispersant made from 2000 Mn $C_{12}$-assisted PIBSA and polyamine. | 7.5% | 7.5% | |
| | Ashless dispersant made from 2000 Mn DA PIBSA and triethylene tetraamine | 30.0% | | 30.0% |
| | A 400 TBN overbased Ca alkylbenzenensulfonate detergent | 21.5% | | |
| | A $10^5$-$10^6$ Mn olefin copolymer in mineral oil, kin vis @ 100 C. (D445_100) = 1500 cSt | 3.5% | | |
| | Trialkyl borate corrosion inhibitor | 5.0% | 2.5% | 2.5% |
| | Total | 100.0% | 42.5% | 57.5% |
| | Cone penetrometer = | 100 mm | | |

Comparative Examples

Comparative Ex 6

TABLE 6

| No-ash Comparative Example | Component | % wt | A | B |
|---|---|---|---|---|
| | A maleic anhydride/styrene copolymer partially esterified with C16/18 alcohol mixture to SRV 0.60, 40% mineral oil | 9.4% | 9.4% | |
| | Ashless dispersant made from 2000 Mn DA PIBSA and triethylene tetraamine | 84.1% | | 84.1% |
| | Trialkyl borate corrosion inhibitor | 6.5% | 3.25% | 3.25% |
| | Total | 100.0% | 12.65% | 87.35% |
| | Cone Penetrometer = | 100 mm | | |

Comparative Ex 7

TABLE 7

| High-ash Comparative Example | Component | % wt | A | B |
|---|---|---|---|---|
| | A 400 TBN overbased CA alkylbenzenensulfonate detergent | 60.0% | | 60.0% |
| | Ashless dispersant made from 2000 Mn $C_{12}$-assisted PIBSA and polyamine | 20.0% | 20.0% | |
| | Nonylated diphenylamine antioxidant | 20.0% | 20.0% | |
| | Total | 100.0% | 40.0% | 60.0% |
| | Cone Penetrometer = | 50 mm | | |

Example 8

TBN Release Example

About 5 g of gel (formulation identified by example number) placed in about 50 g of Valvoline All Climate 10W-30 oil, and heated at about 100 c; the sample was withdrawn at 1, 4, 7 and 11 days and tested for TBN using ASTM D4739 method. The results are shown in Table 8 below.

TABLE 8

| | Percent of TBN Release | | | | |
|---|---|---|---|---|---|
| Gel Formulation | Day 0 | Day 1 | Day 4 | Day 7 | Day 11 |
| Example 1 | 0 | 9% | 51% | 69% | 87% |
| Example 2 | 0 | 9% | 50% | 68% | 82% |
| Example 3 | 0 | 11% | 45% | 57% | 93% |
| Example 6 | 0 | 21% | 58% | 52% | 93% |
| Example 7 | 0 | 20% | 55% | 59% | 90% |

Example 9

Lower-than-Theoretical Ash Release

A gel comprised of about (60% 400 TBN overbased Ca alkylbenzene sulfonate detergents about 20% ashless dispersant made from 2000 Mn PIBSA and about 20% nonylated diphenylamine antioxidant gel was loaded into diesel filters (320-420 g/filter), and installed onto a Series 60 Detroit Diesel Engine (two filters per truck) and run to about 30,000 to about 40,000 miles. Percent Ca (tested by ICP) and sulfated ash (tested by D874) present in the oil (Delo 400) was measured at the start, and the end of each of three tests.

Table 9 shows that the amount of sulfated ash (i.e. as CaSO4) actually measured (by ASTM D874) which is only about 75 to about 90% of that predicted based on the amount of Ca released.

TABLE 9

| | Ca | Ash | |
|---|---|---|---|
| Example 9 (320 g) | | | |
| Theory | 0.1701% | 0.51% | |
| Measured | 0.1100% | 0.28% | |
| Dates | Oct. 30, 2003 to Feb. 13, 2004 | 0.37% | Predicted (by % Ca meas) |
| % Ca Release | 65% | 75% | % ash measured/predicted |
| Example 9 (340 g) | | | |
| | 0.1807% | 0.54% | |
| Measured | 0.1140% | 0.35% | |
| Dates | Jun. 4, 2003 to Jul. 19, 2003 | 0.39% | Predicted (by % Ca meas) |
| % Ca Release | 63% | 90% | % ash measured/predicted |
| Example 9 Full | | | |
| | 0.2073% | 0.62% | |
| Measured | 0.1378% | 0.38% | |
| Dates | Jul. 19, 2003 to Oct. 04, 2003 | 0.47% | Predicted (by % Ca meas) |
| % Ca Release | 66% | 81% | % ash measured/predicted |

Example 10

In the same make and model truck and test conditions used in Example 9, three runs were made using baseline (Delo 400) oil (9 TBN), baseline oil+detergent DTB booster (13 TBN) and baseline oil plus 4 TBN added via the gel filter, using the same gel as in Example 9 The trucks were run to TBN/TAN crossover (end of useful life) and the amount of ash present in the oil measured by D874). The results are shown in Table 10 and FIG. 1 which shows that addition of TBN and ash via the gel provides more miles of service than the equivalent amount of TBN added to the oil at the start of service.

TABLE 10

| | % Ash | TBN | Miles | % Ash/ 1000 miles |
|---|---|---|---|---|
| Fluid | 1.24% | 9 | 23,000 | 0.054% |
| Top Treat | 1.74% | 13 | 37,000 | 0.047% |
| Gel | 1.24 + 0.50% | 9 + 4 | 64,000 | 0.027% |

DRAWINGS

FIG. 1 depicts the results from Example 10.

We claim:

1. A controlled release gel composition comprising ash producing components and ash free components wherein the gel comprises:

1) an ashless dispersant component comprising the reaction product a polyisobutylene succinic anhydride and a polyamine, wherein the dispersant is present in the gel from 35% to 60% by weight;
2) an ashless acid component comprising maleic styrene copolymers, esters and partial esters thereof and mixtures thereof, where the ashless acid is present in the gel from 7.5% to 15% by weight;
3) an overbased metal detergent component, comprising an overbased calcium alkylbenzene sulfonate detergent, wherein the detergent is present in the gel from 17.2% to 21.5% by weight; and
4) optionally other lubricant additives;

resulting in a lubricant additive controlled release with a reduced level of ash, metal and SAPS producing components for delivery of additives into a lubricant.

2. The composition of claim 1 wherein component (4) comprises an olefin copolymer viscosity modifier present in the gel from 2.7% to 3.5% by weight, and wherein component (4) may further comprise one or more additional lubricant additives.

3. The composition of claim 1 wherein component (1), the ashless dispersant component, further comprises an additional ashless dispersant selected from the group consisting of Mannich dispersants, polymeric dispersants, carboxylic dispersants, amine dispersants and mixtures thereof and characterized by a polar group attached to relatively high molecular weight hydrocarbon chain.

4. The composition of claim 1 wherein component (2), the ashless acid component, further comprises an additional ashless acid selected from the group consisting of polymers formed from styrene and maleic anhydride; polymers formed from acrylates selected from the group consisting of acrylic acid, acrylic acid esters, methacrylic acid and its esters; polymers formed from high molecular weight acids and esters wherein the Cn has $n \leqq 12$; polymers formed from esterified maleic anhydride styrene copolymers; polymers formed from esterified ethylene diene monomer copolymers; surfactants with acidic groups in the backbone; emulsifiers with acidic groups in the backbone; polyacidic compounds; polyacidic surfactants; polyacidic dispersants; and functionalized derivatives of each component listed herein and mixtures thereof.

5. The composition of claim 1 wherein component (3), the overbased detergent component, further comprises an additional detergent selected from the group consisting of overbased metal sulfonates, overbased metal phenates, overbased metal salicylates, overbased metal saliginates, overbased metal carboxylates, overbased calcium detergents, overbased detergents containing Mg, Ba, Sr, Na, Ca and K and mixtures thereof and wherein the overbased detergent is characterized as metal salts or complexes characterized by a metal content in excess of that which would be present according to the stoichiometry of the metal and the particular acidic organic compound reacted with the metal.

6. The composition of claim 1 wherein component (4) comprises a lubricant additive selected from the group consisting of viscosity modifier(s), friction modifier(s), ashless detergent(s), cloud point depressant(s), pour point depressant(s), demulsifier(s), flow improver(s), anti static agent(s), ashless dispersant(s), ashless antioxidant(s), antifoam(s), corrosion/rust inhibitor(s), extreme pressure/antiwear agent(s), wear reducing agents, seal swell agent(s), lubricity aid(s), antimisting agent(s) and mixtures thereof; resulting in a controlled release gel that over time releases at least one of the lubricant additives into the lubricant when the controlled release gel is in contact with the lubricant.

7. The composition of claim 1 wherein the ash levels produced are less than the total amount of ash component in the gel.

8. The composition of claim 1 used in an internal combustion engine lubricating system, and wherein the composition has at least one of a sulfated ash, a phosphorous and sulfur levels significantly below the SAPS level of a lubricant formulated to perform to an equivalent level.

9. A process for control releasing an additive into a lubricant comprising (1) supplying one or more desired additives to a lubricant; and (2) contacting the lubricant with a controlled release gel wherein the gel composition comprises ash producing components and ash-free components wherein the gel comprises:

1) an ashless dispersant comprising the reaction product a polyisobutylene succinic anhydride and a polyamine, wherein the dispersant is present in the gel from 35% to 60% by weight;
2) an ashless acid comprising maleic styrene copolymers, esters and partial esters thereof and mixtures thereof, where the ashless acid is present in the gel from 7.5% to 15% by weight;
3) an overbased metal detergent, comprising an overbased calcium alkylbenzene sulfonate detergent, wherein the detergent is present in the gel from 17.2% to 21.5% by weight; and
4) optionally other lubricant additives;

resulting in a lubricant additive controlled release with a reduced level of ash, metal and SAPS producing components for delivery of additives into a lubricant.

10. The process of claim 9 wherein the total amount of ash that dissolves into the lubricant from the controlled release gel is less than the total theoretical amount of dissolved ash in view of the amount of ash component in the controlled release gel and the amount of ash component in the lubricant.

11. The process of claim 9 wherein the controlled release gel is positioned so that the controlled release gel is in contact with the lubricant in a lubricating device.

12. The process of claim 9 wherein the controlled release gel is used in a lubricating conditioning device selected from the group consisting of internal combustion engines, mobil engines, stationary engines, natural gas engines, marine diesel engines, generators, power equipment, hydraulic systems, lubricated mechanical systems, transmission systems, automatic transmission gears, gears, gear boxes, manual transmissions, differentials, metal working coolant systems, metal-working fluid systems, suspensions systems, and industrial lubricated systems.

13. The process of claim 9 wherein component (4) comprises an olefin copolymer viscosity modifier present in the gel from 2.7% to 3.5% by weight, and wherein component (4) may further comprise one or more additional lubricant additives.

* * * * *